US006401350B2

(12) United States Patent
Ford

(10) Patent No.: US 6,401,350 B2
(45) **Date of Patent: *Jun. 11, 2002**

(54) MEASURING TAG FOR ENABLING SIZING OF A GARMENT BELT

(75) Inventor: Allan L. Ford, Melrose Park, PA (US)

(73) Assignee: Reborn Products Co., Inc., Bensalem, PA (US)

( * ) Notice: Subject to any disclaimer, the term of this patent is extended or adjusted under 35 U.S.C. 154(b) by 24 days.

This patent is subject to a terminal disclaimer.

(21) Appl. No.: 09/823,332

(22) Filed: Mar. 30, 2001

Related U.S. Application Data

(63) Continuation of application No. 09/356,308, filed on Jul. 16, 1999, now Pat. No. 6,233,839.

(51) Int. Cl.[7] ..... G01B 3/14
(52) U.S. Cl. ..... 33/562; 33/2 R
(58) Field of Search ..... 33/2 R, 11, 16, 33/483, 492, 494, 755, 758, 759, 760, 512, 562, 563, 566, 679.1

(56) References Cited

U.S. PATENT DOCUMENTS

| | | | | |
|---|---|---|---|---|
| 3,685,155 A | | 8/1972 | Oblander | |
| 3,832,780 A | * | 9/1974 | Lewis | 33/512 |
| 3,918,166 A | * | 11/1975 | Mason | 33/512 |
| 5,771,598 A | | 6/1998 | Lassberg | |
| 5,774,999 A | | 7/1998 | Smith | |
| 5,881,469 A | | 3/1999 | Monck | |
| 5,920,998 A | * | 7/1999 | Slilaty | 33/512 |
| 5,943,974 A | * | 8/1999 | Hoag | 33/492 |
| 5,950,321 A | * | 9/1999 | Pena et al. | 33/758 |
| 6,044,572 A | | 4/2000 | Sore et al. | |
| 6,145,210 A | * | 11/2000 | Walczynski | 33/492 |
| 6,158,135 A | * | 12/2000 | Rank | 33/494 |
| 6,233,839 B1 | * | 5/2001 | Ford | 33/562 |
| RE37,212 E | * | 6/2001 | Marshall | 33/494 |
| 6,272,761 B1 | * | 8/2001 | Pechter | 33/512 |

FOREIGN PATENT DOCUMENTS

| | | |
|---|---|---|
| GB | 2 106 250 A | 4/1983 |
| GB | 2 179 743 | 3/1987 |

* cited by examiner

*Primary Examiner*—Diego Gutierrez
*Assistant Examiner*—Yaritza Guadalupe
(74) *Attorney, Agent, or Firm*—Caesar, Rivise, Bernstein, Cohen & Pokotilow, Ltd.

(57) ABSTRACT

A measuring tag for releasable securement to a garment belt to facilitate the cutting of the belt to a desired size. The belt has a buckle including a throat for releasably clamping a first end of the belt to it. The tag is an elongated planar member whose periphery includes a top edge, a bottom edge, and a pair of longitudinally extending side edge. The top edge has an ear folded back over itself to form a socket having a stop surface against which a first end portion of the belt abuts. The ear and the first end of the belt are releasably received in the throat of the buckle. The measuring tag also includes a surface, e.g., the rear, on which measuring indicia are provided. That indicia is a longitudinally extending size chart including a pair of side-by-side rulers showing belt sizes in inches and pant sizes in inches. The tag is formed of a material which is severable at various locations along the indicia to sever it and the portion of the belt at that location, whereupon the remaining length of the belt is of a desired size as indicated by the indicium at the location at which the tag is severed. The tag also includes second surface, e.g., the front, which includes product identification indicia, e.g., promotional text, graphics, etc.

10 Claims, 3 Drawing Sheets

MEASURING TAG FOR ENABLING SIZING OF A GARMENT BELT

RELATED APPLICATION

This application is a continuation of U.S. patent application Ser. No. 09/356,308, filed Jul. 16, 1999 now U.S. Pat. No. 6,233,839 entitled Measuring Tag For Enabling Sizing Of A Garment Belt, whose disclosure is incorporated by reference herein.

BACKGROUND OF THE INVENTION

This invention relates generally to tags for vending garment belt, and more particularly to tags which enable one to readily sever a garment belt to customize it to a desired size.

Garment belts are frequently mass marketed by vendors by displaying a large number of belts a display rack. The belts are commonly segregated by size, color, and any other attributes deemed relevant to the purchaser. Typically in the vending of belts in this manner each belt may include a tag or hanger bearing some indicia relating to the belt, e.g., its size, color, manufacturer/vendor, etc.

Some garment belts, particularly those intended for men, are made sufficiently long to cover a range of sizes and are designed to enable the purchaser to cut the belt to any desired size within a designated range, e.g., "all sizes to 42 inches," and thereby customize the belt to the purchaser's waist or pants size. To that end such belts typically include a buckle which is constructed so that it can be removed from the belt end to which it had been attached (e.g., the "flat" end of the belt) so that the user can cut the belt to the desired length. The buckle may include a throat or space into which the flat end of the belt extends and a clamp or some other releasable securement member, e.g., at least one set screw, to hold that belt end within the throat/space. In order to custom size such a belt all that the purchaser has to do is to sever the belt at any position from the buckle back toward the tip so that the length of the severed section is his/her waist size, and then replace the buckle on the square end of the newly severed belt section.

One drawback of this arrangement is that in order to ensure that the belt is customized the desired length, the purchaser has to have some accurate means to measure the length of the belt from its free end tip to the point at which it will be severed. Typically the means utilized has been a conventional ruler, tape measure, yard stick, etc.

Accordingly, a need exists for a device for use in vending belts which overcomes the disadvantages of the prior art to facilitate the custom sizing of garment belts.

OBJECTS OF THE INVENTION

It is therefore an object of this invention to provide a tag for use on a garment belt to facilitate the custom sizing of the belt.

It is a further object of this invention to provide a tag for use on a garment belt, wherein the tag includes measuring indicia to facilitate the sizing of the belt to any desired length.

It is still a further object of this invention to provide a measuring tag for use on a garment belt which is easy to use to custom size the belt to any desired length.

It is still a further object of this invention to provide a measuring tag for use on a garment belt which is simple in construction.

It is still a further object of this invention to provide a measuring tag for use on a garment belt which is low in cost.

It is still a further object of this invention to provide a tag for use on a garment belt, wherein the tag includes merchandising indicia as well as measuring indicia to facilitate the sizing of the belt to any desired length.

SUMMARY OF THE INVENTION

These and other objects of this invention are accomplished by providing a measuring tag for releasable securement to a garment belt, e.g., a reversible belt, to facilitate the cutting of the belt to a desired size, e.g., size "36" pants." The belt includes a buckle having a throat or slot into which a first end portion of the belt may be received to releasably secure, e.g., clamp, the buckle to the belt.

The measuring tag comprises an elongated planar strip-like member having a pair of opposed surfaces, e.g., a front surface and a rear surface. The periphery of the strip-like member includes a top edge portion, a bottom edge portion, and a pair of longitudinally extending opposed side edge portions. The top edge portion includes an ear projecting outward from it. The ear has an end wall, e.g., a portion folded back over itself, to form a stop surface against which the first end portion of the belt abuts to hold the belt in position thereat. The ear of the tag is sufficiently thin to enable the throat or slot of the buckle to readily receive the ear and the contiguous first end portion of the belt to releasably secure, e.g., clamp, the tag to the belt.

The first surface, e.g., rear surface, of the tag has measuring indicia, e.g., side-by-side rulers showing belt sizes in inches and pant sizes in inches extending along at least a portion of one of the longitudinal extending side edge portions of the measuring tag.

The tag is formed of a material, e.g., plastic or plastic-coated cardboard or paper stock, which is severable by a scissors at various locations along the indicia to sever the tag and the belt thereat, whereupon the remaining length of the belt is of a desired size as indicated by the indicium at the location at which the tag is severed.

In accordance with one preferred aspect of this invention the second surface of the measuring tag, e.g., the top surface, also includes indicia thereon. That indicia may comprise product identification indicia, e.g., promotional text, graphics, etc. Thus, the tag may be used for merchandising display purposes when mounted on the belt before custom sizing of the belt.

The measuring tag may also include an opening in it located spaced from the end at which the ear projects and through which the belt is extended to further secure the tag to the belt.

Another aspect of this invention constitutes the combination of the measuring tag and the belt.

DESCRIPTION OF THE DRAWINGS

Other objects and many of the attendant advantages of this invention will become readily appreciated as the same becomes better understood by reference to the following detailed description, when considered in connection with the accompanying drawing, wherein.

DETAILED DESCRIPTION OF THE PREFERRED EMBODIMENT

Figure 1:
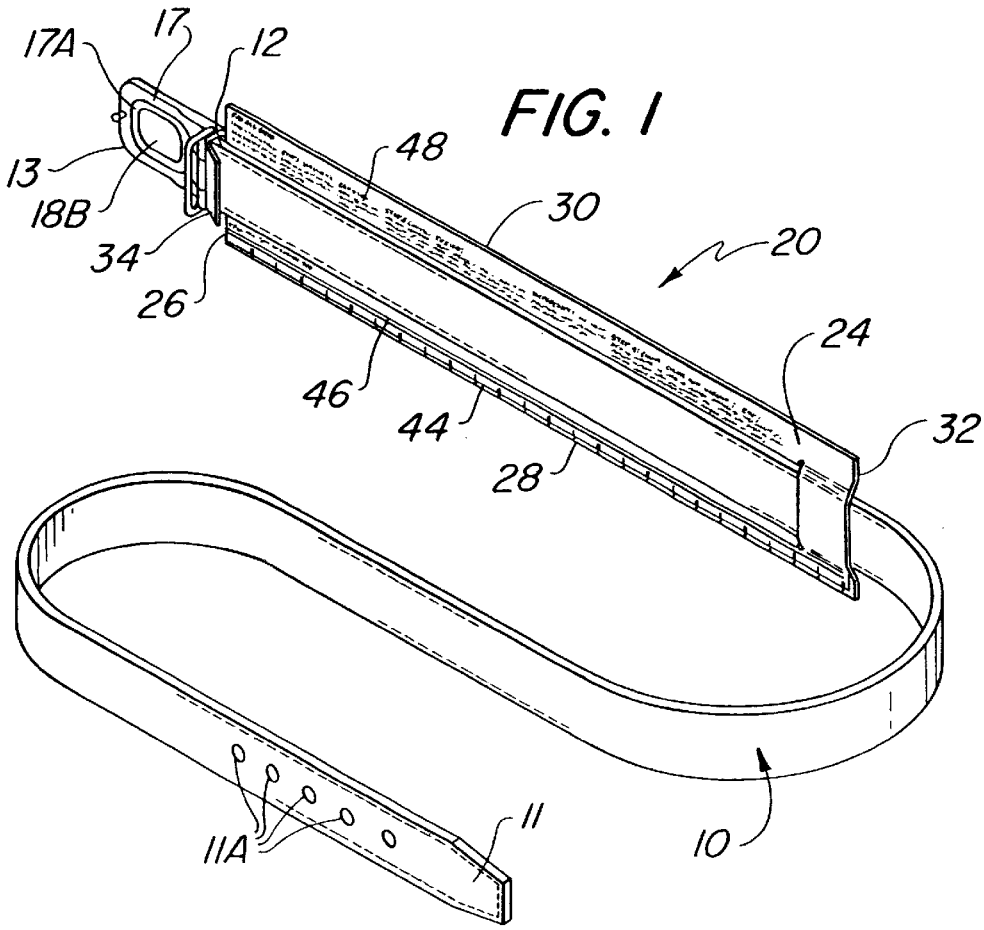
FIG. 1 is an isometric view of the measuring tag of the subject invention shown releasably mounted on a belt which is arranged to be custom sized by cutting it at a desired location as designated by the measuring tag.

Referring now in greater detail to the various figures of the drawing, wherein like reference characters refer to like parts, there is shown generally at 20 in FIG. 1 a measuring tag or "size strip" constructed in accordance with this invention for use in merchandising a garment belt 10. The tag 20 is designed for releasable mounting on any type of belt having a removable buckle. As will be described in detail later, the tag when mounted on the belt enables the purchaser to sever the belt at any point along its length (as indicated by sizing indicia on the tag) to customize the belt's length to his/her waist or pants size. Then the buckle may be removed from the severed section of the belt and replaced on the newly formed end of the customized belt length to complete the custom sizing of the belt.

Before describing the details of the measuring tag 20, a brief description of the belt 10 is in order. To that end the belt comprises an elongated strip or strap of any suitable material, e.g., leather, having a free end 11 at which plural equidistantly spaced buckle holes 11A are located. The non-free or "flat" end 12 of the belt 10 has any conventional buckle 13 releasably mounted thereon. The belt may be of one color and/or texture (e.g., black smooth leather) on one side, and a different color and/or texture (e.g., brown, pebble grain leather) on the other side so that the purchaser can reversibly mount the buckle 13 so that either side of the belt is visible to provide the wearer with different "looks" for the belt. As will be described later the buckle 13 may be of any shape desired and may also include at least one reversible portion to provide additional different "looks" for the belt, depending upon which portion of the buckle is oriented outward to be visible.

Figure 4:
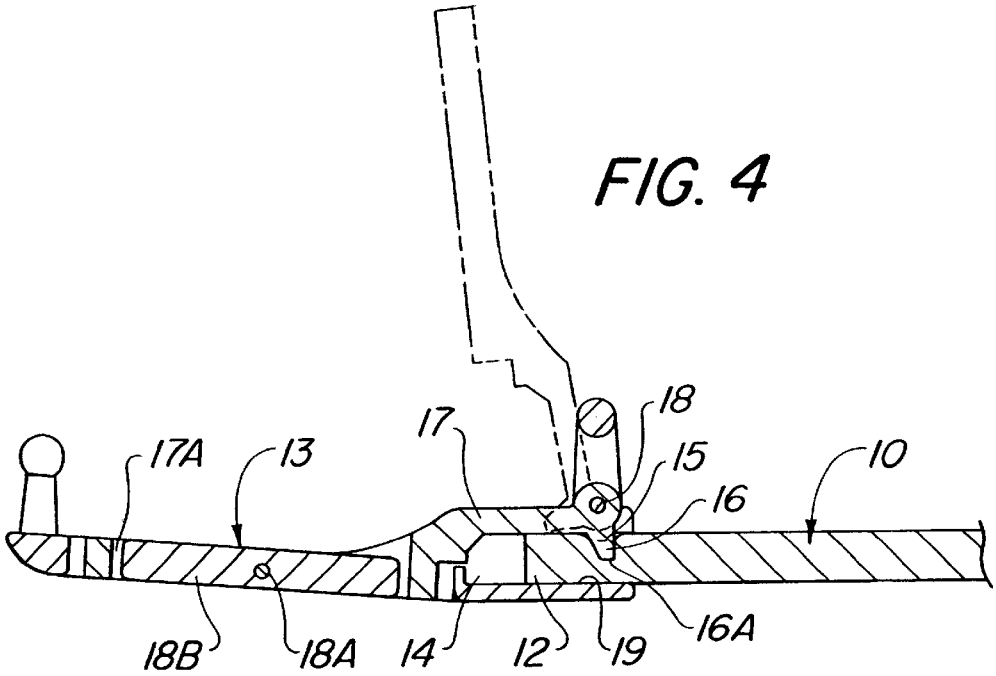
FIG. 4 is an enlarged sectional view of the buckle end of the belt shown in FIG. 4 demonstrating how the buckle is remounted on the belt after the belt has been sized using the measuring tag of this invention.

The means for releasably mounting the buckle 13 on the square end 12 of the belt may take any form. For example, in the embodiment of the belt 10 shown herein it comprises a throat or hollow slot 14 (FIGS. 3 and 4) in the buckle 13 and in which a pivotable clamp 15 is located. The clamp includes a jaw 16 and an arm 17 projecting therefrom. The jaw 16 is an elongated member having a serrated free edge 16A. The jaw is mounted on a pivot pin 18 which extends across the width of the slot 14 perpendicular to the longitudinal axis of the belt. The arm 17 is arranged to be pivoted outward from the plane of the buckle to cause the serrated edge 16A of the jaw 16 to pivot outward, away from the opposed wall 19 (FIG. 4) of the slot 14, to establish a space therebetween into which the flat end 12 of the belt and an "ear" portion of the tag 20 (to be described later) is received. Then the buckle's arm 17 can be pivoted inward back into the plane of the buckle to cause the concomitant pivoting of the clamp 15, whereupon the serrated edge 16A of the jaw 16 moves into tight engagement with the "ear" portion of the tag and the interposed belt end 12 to tightly squeeze or clamp them in place. This action has the effect of securely mounting the buckle 13 on the belt 10 and also mounting the tag 20 on the belt. The buckle can, if desired, be readily removed by merely pivoting it's arm outward with respect to the plane of the buckle, thereby opening the clamp.

It should be noted at this point that the arm 17 of the buckle may be a decorative component. For example, in the exemplary example shown the arm 17 is of a decorative shape and surface appearance, e.g., it has a rectangular shape with a rectangular opening 17A in the center. Moreover, it includes a decorative rotatable rectangular plate 18B. Although not shown, the plate 18B may bear a monogram, e.g., the letter "A", on one side and decorative lines on its opposite side. The plate 18B is arranged to be rotated about a pivot pin 18A extending into opening 17A transversely to the longitudinal axis of the belt and in the plane of the arm 17 so that either the monogram side or the decorative lined side of the plate is visible.

It should be pointed out at this juncture that the means for releasably securing the buckle to the belt can take other forms than the heretofore described clamp. For example, the buckle may include one or more set screws (not shown) which thread into the slot 14 to engage portions of the belt's flat end 12 contiguous therewith. Moreover, the buckle 13 itself may be constructed differently than shown herein and may provide any desired appearance. What is important is that the buckle should include some means which serves to releasably mount the tag 20 onto the belt, but which permits the ready release of the tag when desired, e.g., after the tag has been used to size the belt.

Figure 2:
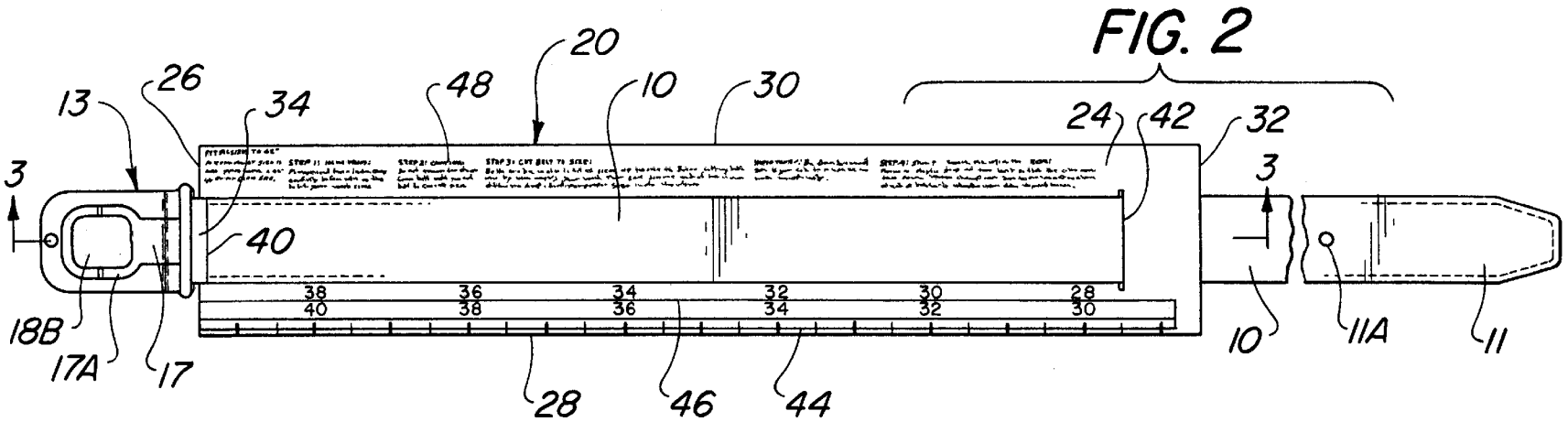
FIG. 2 is a plan view of the combination of the measuring tag and belt shown in FIG. 1 and showing one side of the measuring tag.
Figure 3:
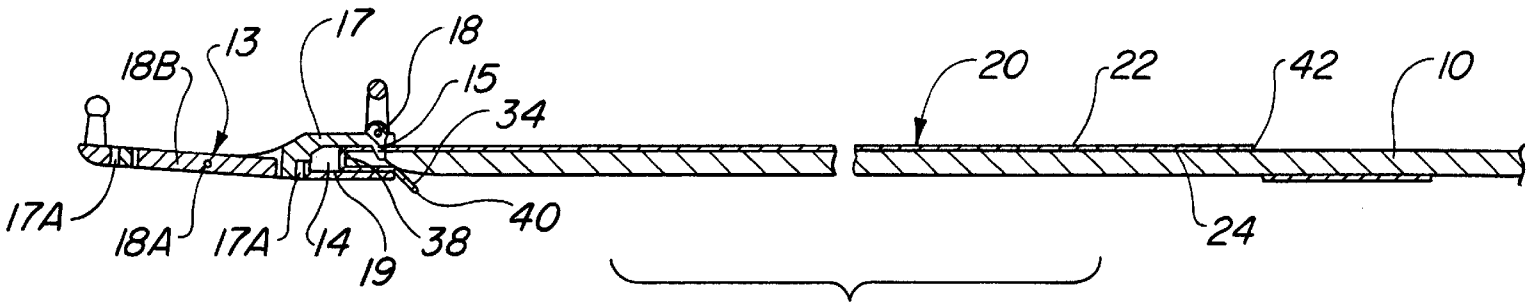
FIG. 3 is a sectional view taken along line 3—3 of FIG. 2.
Figure 5:
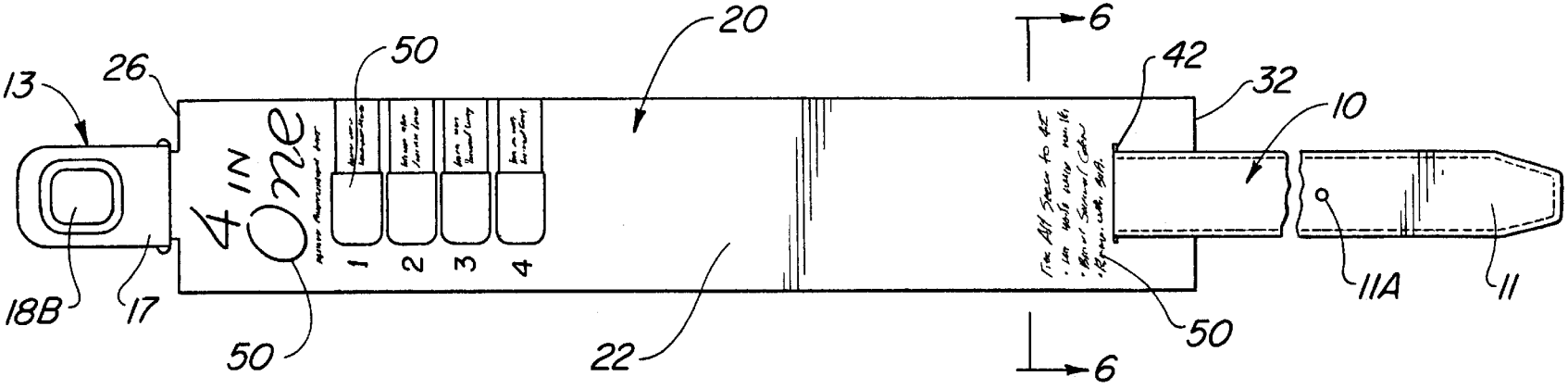
FIG. 5 is a plan view of the combination of the measuring tag and belt shown in FIG. 1 and showing the opposite side of the measuring tag from that shown in FIG. 2.
Figure 6:
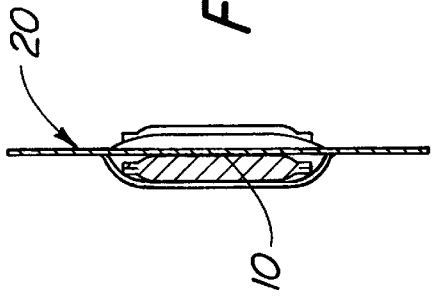
FIG. 6 is an enlarged sectional view taken along line 6—6 of FIG. 5.

Referring now to FIGS. 1–3 the details of the measuring tag 20 will now be described. As can be seen therein the tag 20 basically comprises a thin, planar strip of any suitable somewhat flexible material, e.g., plastic, plastic-coated paper or card stock, etc. The strip is of a generally rectangular shape and has a front surface 22 (FIG. 5) and a rear surface 24 (FIGS. 1–3), bounded by a periphery comprising a top edge 26, a pair of opposed longitudinally extending side edges 28 and 30, and a bottom edge 32. The heretofore-mentioned "ear" which is designated by the reference numeral 34 projects outward from the top edge 26 and is centered on the longitudinal central axis of the tag. The ear is of the same thickness as the strip itself, e.g., the strip and ear are formed, e.g., die cut, as an integral unit from a blank of material. The material and thickness of the strip are such that it is flexible, whereupon the ear can be bent backwards over itself like shown in FIG. 3 to form a pocket having a back wall 38. The inner surface of the back wall of the pocket serves as a stop to accurately position the flat end 12 of the belt 10 up against it within the pocket 36. The free end portion 40 of the ear 34 extends over the flat end 12 of the belt 10 when it is in place in the pocket. The combined thickness of the portions of the ear bounding the pocket and the thickness of the flat end 12 of the belt within the pocket is sufficiently small so that it may fit within the throat 14 of the buckle between the clamp jaw 16 and the slot wall 19 when the clamp is in the open position, i.e., when the arm of the clamp is pivoted out of the plane of the buckle. When the arm of the clamp is pivoted inward, the serrated edge of the clamp digs into the underlying portion of the ear 34 and the contiguous portion of the belt to tightly squeeze the ear and interposed belt portion between it and the opposed wall 19 of the throat of the buckle. This action securely, albeit releasably, locks the buckle and the measuring tag onto the belt as long as the clamp arm 17 remains in the plane of the buckle like shown in FIG. 3.

With the tag 20 as mounted on the belt as just described it extends along a substantial portion, e.g., slightly over 12 inches, of the length of the belt. A slot or slit 42 is located in the tag closely adjacent the bottom edge 32. The belt 10 is arranged to be extended through the slit 42, whereupon the tag is then held securely to the belt at its opposite end edges 26 and 32.

The back or rear surface 24 of the tag includes a printed indicia "size chart" in the form of side-by-side rulers 44 and 46. The rulers are graduated in half inch segments and extend closely along one of the side edges, e.g., edge 28, of the tag, so that they are clearly visible when the tag is in place on the belt (with the tag in place the central longitudinal portion of the back surface 24 of the tag will be obscured by the belt itself). The indicia 44 constitutes a "pant size" ruler having numerical markings every two inches (e.g., 28", 30", 32" . . . 38"). The indicia 46 constitutes "belt size" ruler having numerical markings every two inches (e.g., 30", 32", 34" . . . 40") etc. As is known to those skilled in the apparel art, for any particular belt size in inches, the corresponding pant size in inches is two inches greater. Hence the pant size ruler indicia 44 representing 28", 30", 32", 34", 36", and 38" are disposed immediately adjacent the belt size ruler indicia 46 representing 30", 32", 34", 36",38", and 40", respectively. This factor is made evident to the user by the inclusion of the statement "Size Chart (Belt Size=Pant Size+2)" immediately adjacent the size chart of rulers 44 and 46.

As can be seen in FIGS. 1 and 2, other indicia 48, such as instructional materials on how to use the tag 20 to custom size the belt 10, are also provided on the back surface 24. This instructional indicia is preferably located along the opposite edge 30 of the tag so that the indicia is not obscured by the belt itself. In the exemplary embodiment, where the belt is designed to be used by persons whose waist size is no greater than 42", the indicia 48 comprises the following use instruction text: "If your waist size is 42" and your slack size is 40" do not cut this belt. STEP 1: IMPORTANT: Please read these instructions carefully before cutting this belt to fit your waist size. STEP 2: CAUTION: Do not remove size strip from belt until you cut the belt to correct size. STEP 3: CUT BELT TO SIZE: Belt can be made to fit all sizes up to size 42. Before cutting the belt, check you belt size by measuring your waist. Make sure square end of belt is attached to the end of the size strip. Locate your proper size on the strip and cut with scissors. IMPORTANT: Be sure of correct size. If the cut is larger than required re-cut accordingly. STEP 4: SELECT COLOR AND ASSEMBLE BELT: Remove plastic strip and turn belt so that the color you desire is facing down. With the clamp and buckle as shown, insert cut end of belt fully into upper slot, and press clamp down."

The front surface 22 may also include indicia 50, be it text, graphics or combinations of text and graphics, such as the name, trademark or designation of the belt, an image of the belt shown on a model, and advertising or promotional materials. Thus, when the belt with the tag 20 mounted thereon is displayed for vending, e.g., suspended from a display rack, the indicia on the front surface can be readily seen by the prospective purchaser, to advise him/her of the fact that the belt is customizable in size and to provide other sales enhancing information.

As should be appreciated from the foregoing the subject invention is a simple, low cost, easy to manufacture device which can be conveniently used with any belt arranged to be custom sized by the purchaser.

Without further elaboration, the foregoing will so fully illustrate my invention that others may, by applying current or future knowledge, readily adapt the same for use under various conditions of service.

I claim:

1. A measuring tag arranged to be releasably secured to a garment belt to facilitate the cutting of the belt to a desired size, the belt being of a predetermined maximum size and formed of a material arranged to be cut or severed to the desired size, the belt including a buckle having a throat into which a first end portion of the belt may be received to releasably secure the buckle to the belt, said measuring tag comprising an elongated, one-piece planar strip-like member whose entire length is formed of a flexible material of uniform thickness, said strip-like member having a pair of opposed surfaces and whose periphery includes a top edge portion, a bottom edge portion, a pair of longitudinally extending opposed side edge portions, said top edge portion being arranged to be bent out of the plane of said strip-like member to form an ear projecting outward from the plane of said strip-like member, said ear having an end wall extending at an angle to the plane of the contiguous portion of said planar strip-like member to form an upstanding stop surface against which the first end portion of the belt is arranged to abut to hold the belt in position thereat when said measuring tag is releasably secured to the belt, said ear being arranged to fit within the throat of the buckle with the first end portion of the belt therein when said measuring tag is releasably secured to the belt, said first surface of said measuring tag bearing measuring indicia extending along at least a portion of one of said longitudinal extending side edge portions, said flexible material being severable by a scissors at various locations along said indicia to sever said measuring tag and the belt thereat when said measuring tag is releasably secured to the belt so that the remaining length of the belt is of a desired size as indicated by the indicium at the location at which said measuring tag is severed.

2. The measuring tag of claim 1 wherein said second surface bears product identification indicia thereon.

3. The measuring tag of claim 1 wherein said tag is flexible.

4. The measuring tag of claim 3 wherein said tag is formed of a plastic.

5. The measuring tag of claim 1 wherein said indicia includes belt sizes in inches.

6. The measuring tag of claim 5 wherein said indicia additionally includes pants sizes in inches, said pants sizes in inches indicia being disposed side-by-side with said belt sizes in inches indicia.

7. The measuring tag of claim 6 wherein said indicia is a chart having a pair of rulers extending in side-by-side relation to each other, one of said rulers being said pants sizes in inches indicia and the other of said rulers being said belt sizes in inches indicia.

8. The measuring tag of claim 1 wherein said indicia includes pants sizes in inches.

9. The measuring tag of claim 1 additionally comprising at least one opening in said tag spaced from said through which a portion of the belt extends.

10. A measuring tag arranged to be releasably secured to a garment belt to facilitate the cutting of the belt to a desired size, the belt being of a predetermined maximum size and formed of a material arranged to be cut or severed to the desired size, the belt including a buckle having a throat into which a first end portion of the belt may be received to releasably secure the buckle to the belt, said tag comprising an elongated, planar strip-like member having a pair of opposed surfaces and whose periphery includes a top edge portion, a bottom edge portion, a pair of longitudinally extending opposed side edge portions, said top edge portion including an ear projecting outward therefrom, said ear being folded back over itself to form a pocket having an end wall extending at an angle to the plane of the contiguous portion of said planar strip-like member to form an upstanding stop surface against which the first end portion of the belt is arranged to abut to hold the belt in position thereat, said ear being arranged to fit within the throat of the buckle with the first end portion of the belt therein to releasably secure said tag to the belt, said first surface of said measuring tag bearing measuring indicia extending along at least a portion of one of said longitudinal extending side edge portions, said measuring tag being formed of a material which is severable by a scissors at various locations along said indicia to sever said tag and the belt thereat so that the remaining length of the belt is of a desired size as indicated by the indicium at the location at which said tag is severed.

* * * * *

UNITED STATES PATENT AND TRADEMARK OFFICE

CERTIFICATE OF CORRECTION

PATENT NO. : 6,401,350 B2
APPLICATION NO. : 09/823332
DATED : June 11, 2002
INVENTOR(S) : Allan L. Ford It is certified that error appears in the above-identified patent and that said Letters Patent is hereby corrected as shown below:

Col. 6, Line 53-56
Claim 9 should be corrected to read in full: "The measuring tag of claim 1 additionally comprising at least one opening in said tag spaced from said top edge portion through which a portion of the belt extends."

Signed and Sealed this

Twenty-second Day of December, 2009

David J. Kappos

David J. Kappos
*Director of the United States Patent and Trademark Office*